US005741153A

United States Patent [19]

Schwer

[11] Patent Number: 5,741,153

[45] Date of Patent: Apr. 21, 1998

[54] MODULAR CONNECTORS INCLUDING TERMINATED REAR CONNECTOR DESIGNATION FOR INSULATION DISPLACEMENT CONNECTORS

[75] Inventor: Walter Schwer, Westerly, R.I.

[73] Assignee: Ortronics, Inc., Pawcatuck, Conn.

[21] Appl. No.: 508,023

[22] Filed: Jul. 27, 1995

[51] Int. Cl.[6] ..... H01R 3/00

[52] U.S. Cl. ..... 439/491; 439/718

[58] Field of Search ..... 439/491, 532, 439/188, 668, 716; 379/327

[56] References Cited

U.S. PATENT DOCUMENTS

| | | | |
|---|---|---|---|
| 2,848,703 | 8/1958 | Foote et al. . | |
| 3,067,403 | 12/1962 | Kulka | 439/491 |
| 3,611,264 | 10/1971 | Ellis, Jr. . | |
| 3,798,587 | 3/1974 | Ellis, Jr. et al. . | |
| 3,945,706 | 3/1976 | Steiner et al. | 439/491 |
| 4,118,095 | 10/1978 | Berglund et al. . | |
| 4,180,305 | 12/1979 | Ustin et al. . | |
| 4,797,114 | 1/1989 | Lau | 439/668 |
| 5,080,607 | 1/1992 | Cristescu | 439/491 |
| 5,211,583 | 5/1993 | Endo et al. | 439/491 |
| 5,338,224 | 8/1994 | Blanke et al. | 439/491 |

*Primary Examiner*—Neil Abrams
*Assistant Examiner*—Brian Biggi
*Attorney, Agent, or Firm*—St. Onge Steward Johnston & Reens LLC

[57] ABSTRACT

A designation strip for the rear portion of a communications outlet snaps onto an insulation displacement connector over the wire terminals therein and includes a designation label. The designation strip is attached via attachment flanges which cooperate with regularly-spaced attachment beads connected to the teeth of the insulation displacement connector. The designation strip includes side walls with respect to which the attachment flanges are aligned. During attachment, a side wall of the designation strip is engaged with an end wall of the insulation displacement connector thereby positively aligning the designation strip and the attachment flanges with respect to the insulation displacement connector and the attachment beads thereof. The side walls also serve to prevent the designation strip from becoming misaligned after attachment.

14 Claims, 3 Drawing Sheets

10
12
13
14
16
18
19
20
20'
20''
20'''
21
22
22'
24
26
28
28'
29
30
32
34
36
38
40
42
48
D1
D2
D3
D4

MODULAR CONNECTORS INCLUDING TERMINATED REAR CONNECTOR DESIGNATION FOR INSULATION DISPLACEMENT CONNECTORS

TECHNICAL FIELD

The invention relates to improvements in information management outlet modules. In particular, the invention provides a designation strip which is attached to insulation displacement connectors (IDC's) thereby providing a designation on the rear portion of an outlet module to identify and protect IDC terminations.

Communications technology (including data, video and voice processing and transmission) is placing ever-increasing demands on wire management systems and the personnel responsible for their installation and maintenance. The design of all system components must be done with attention to system integrity and ease of performance of associated manual tasks. This requires that, for practical system assembly and service, the technician must be able to accurately and efficiently identify the terminals and wires which correspond to certain circuits.

While modular jacks commonly provide for such identification on the front surfaces thereof, providing a suitable rear designation has been difficult and is often omitted, despite the requirement of TIA/TEA 606 Wiring System Code for such rear designations. The reason for the omission of rear designations is that the bend radius of terminated wires and the need for cabling ties leaves little space at the rear of modular jacks for providing designations.

BACKGROUND ART

Previously, hang tags have been used to identify terminals, however, hang tags cause an untidy appearance which can make the information displayed by them difficult to read accurately and efficiently without contact with the terminated wires.

U.S. Pat. No. 2,848,703 to Foote and U.S. Pat. No. 3,067,403 to Kulka disclose terminal identification labels consisting of strips of material secured over the terminals of a terminal block. While these devices effectively identify terminal positions and are neater in appearance than hang tags, additional structure is required to secure them to the terminal blocks, and in order to remove them, this structure must first be removed.

U.S. Pat. No. 4,180,305 to Ustin discloses another identification device consisting of a plastic cover which snaps over the barriers between terminals. The Ustin device however, is directed to use with common screw-type terminal blocks and is therefore not suitable for connecting to or identifying terminals of insulation displacement connectors which are in common use today.

A type of rear designation strip that is designed for insulation displacement connectors is disclosed in U.S. Pat. No. 5,080,607 to Cristescu. The Cristescu device is a rear designation strip which snaps onto the connector at the rear of the modular outlet and which provides a surface for displaying a label to identify the circuits terminated underneath the strip. While the Cristescu device provides a means to identify terminals and wires on the rear of a modular connector, it does not ensure that information may always be read accurately and efficiently. The Cristescu device attaches to the insulation displacement connector in such a way that it does not positively align itself with respect to the connector. Therefore, an array of such strips when attached may seem untidy and may be inefficient to read without further time and effort to align them. Also, the Cristescu device may become accidentally displaced or misaligned while remaining attached to the connector thereby creating a risk of misidentification.

Thus, there is a need for a means to provide circuit identification at the rear of IDC-terminated modular jacks, and especially to do so in a manner which protects the terminations, which is neat in appearance, which can be read efficiently, which requires a minimum of time and effort to attach, and which cannot be accidentally misaligned.

DISCLOSURE OF THE INVENTION

It is an object of the present invention to provide a means to aid in the administration of telecommunications wiring systems.

It is another object of the invention to provide a designation strip for display of information relating to circuits terminated on an insulation displacement connector to aid in the administration of telecommunication systems.

It is another object of the invention to provide a designation strip of the above characteristics having means to attach the strip to insulation displacement connectors (IDC's) of the type commonly used to terminate modular jacks.

It is yet another object of the present invention to provide a designation strip of the above description having snap-on attachment flanges which attach to and around the insulation displacement connector.

It is still another object of the present invention to provide a designation strip of the above characteristics with a means to align the strip and attachment flanges with respect to the insulation displacement connector during attachment.

It is still another object of the present invention to provide a designation strip of the above characteristics having a means to prevent the designation strip from being misaligned with respect to the insulation displacement connector after attachment.

Another object of the present invention is to provide a designation strip of the above characteristics having a label held to the front surface thereof.

These and other objects are achieved by the present invention which provides a designation strip which includes a planar base having front and back surfaces, a designation label, a means to attach the designation label to the front surface of the planar base, and a plurality of attachment flanges connected to the back surface of the planar base for attachment to an insulation displacement connector. The attachment flanges have means to engage attachment means on the connector, and the strip includes at least one side wall connected to the back surface thereof to align the strip and the engaging means with the connector and the attachment means of the connector, and to prevent the strip from becoming misaligned after attachment.

These and other preferred aspects of the invention are described in more detail below.

BRIEF DESCRIPTION OF THE DRAWINGS

The invention will be better understood and its advantages will be better appreciated from the following detailed description, especially when read in light of the accompanying drawings, wherein.

INDUSTRIAL APPLICABILITY

The improvements of the invention have application to the field of communication outlets employing insulation displacement connectors. Wire connecting systems of the type herein described as insulation displacement connectors are well known and commercially available. An example of such a system is the "110 connector system" available from AT&T Technologies. "110 type wiring systems" are described in several prior patents including U.S. Pat. Nos. 3,611,264; 3,798,587; and 4,118,095.

The drawings are intended to depict plugs and outlets of the RJ-45 type, but the invention is not limited to such. The term "RJ-type connector" is defined herein to include, specifically, the various modular communication connectors assigned RJ numbers according to the USOC. The description will refer to various parts by their usual orientation (e.g., front, back, top and bottom), however, this is done for ease of description and is not meant to limit the orientation of the devices in actual use.

Figures 1, 7, 8:
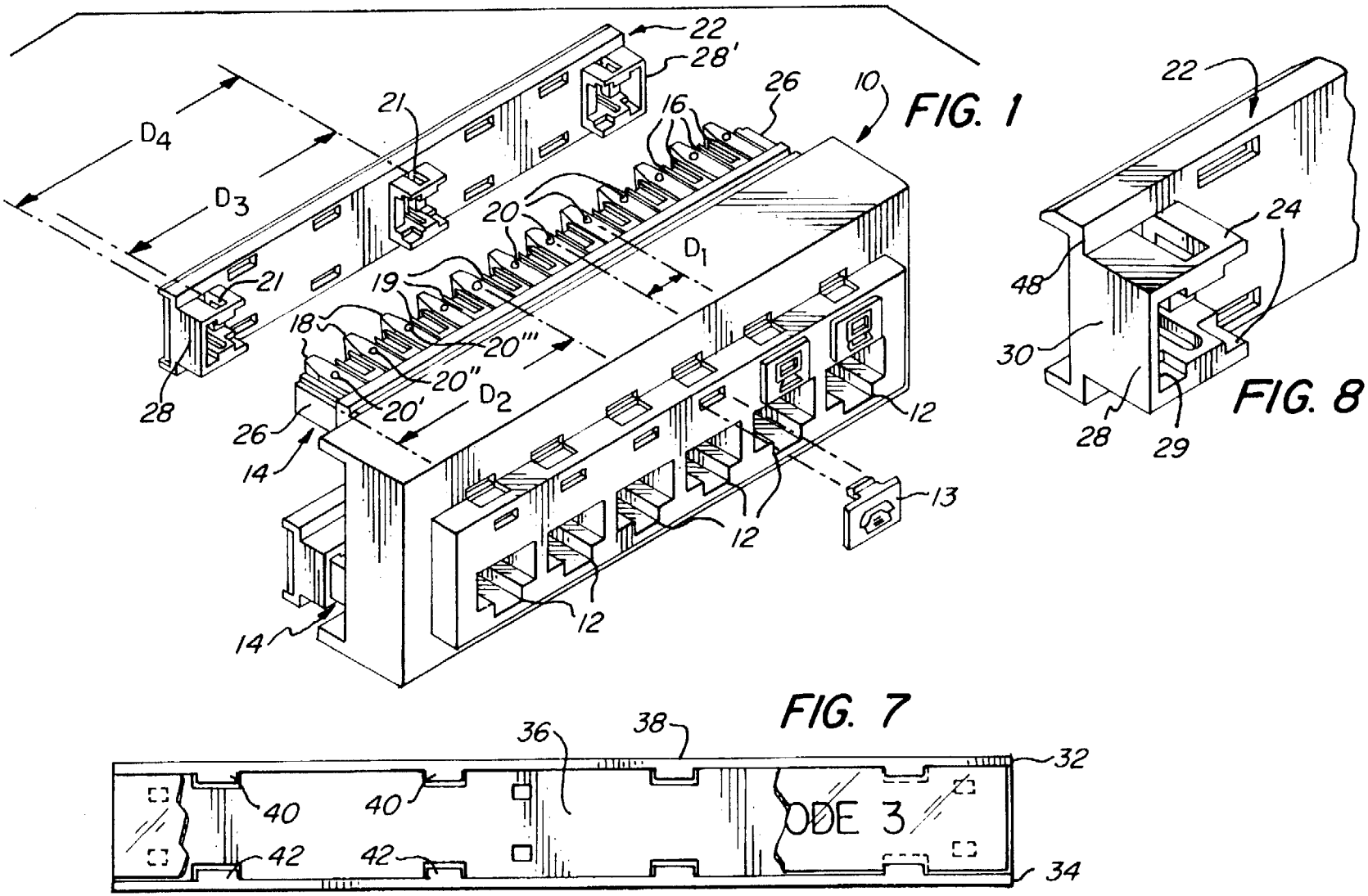
FIG. 1 is a exploded, perspective view of an outlet module assembly having two insulation displacement connectors one of which is covered by a designation strip of the present invention.
FIG. 7 is a front view of the designation strip of FIG. 1 showing a cut-away view of a designation label inserted in the designation strip.
FIG. 8 is a perspective cut-away view of the designation strip of FIG. 4 showing the back surface, opposing attachment flanges, and an integrally-formed side wall employed to align the strip.

FIG. 1 shows an outlet module 10 having modular jacks 12 electrically connected to insulation displacement connectors 14 which are known in the art. The insulation displacement connectors 14 have a row of terminal slots 16 formed by alternating long teeth 18 and short teeth 19. Wires (not shown) may be secured by opposing conductors (also not shown) within the terminal slots 16. All of the long teeth 18 also include beads 20 on both sides thereof. Some of the short teeth 19 also include beads (not shown) however the beads on the short teeth 19 are typically only on one side of the tooth and are not employed by the present invention.

Front designations such as the tab 13 may be placed adjacent the modular jacks 12 to indicate the port number and/or type. The rear designations strips 22 indicate the corresponding information when the outlet module 10 is viewed from the back.

Figure 2:
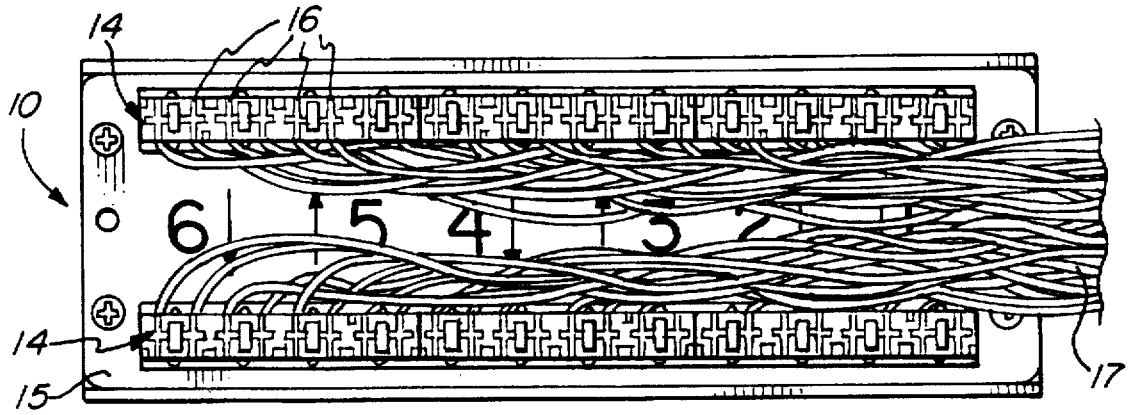
FIG. 2 is a rear elevation view of an outlet module showing a full array of wires connected to the insulation displacement connectors.

Referring to FIG. 2 an outlet module may have insulation displacement connectors 14 which are connected a base 15 (commonly a printed circuit board) and which are electrically connected to modular jacks (hidden). Wires 17 are held in terminal slots 16 by the opposing conductors (not shown) within the terminal slots 16.

Figure 3:
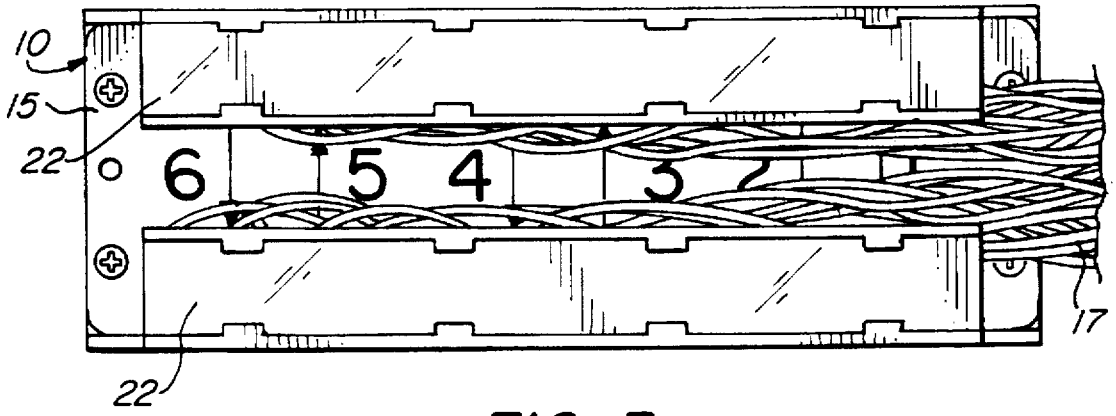
FIG. 3 is a rear elevation view of an outlet module assembly showing two designation strips of the present invention attached to and positively aligned with the connectors, and covering the full array of wires.

Referring to FIG. 3, rear designation strips 22 may be attached over the insulation displacement connectors 14 (hidden) thereby providing an organized appearance and a support for circuit designation labels. The designation strips 22 are aligned with one another and with the connectors thereby providing an organized and easily readable display.

Figure 6:
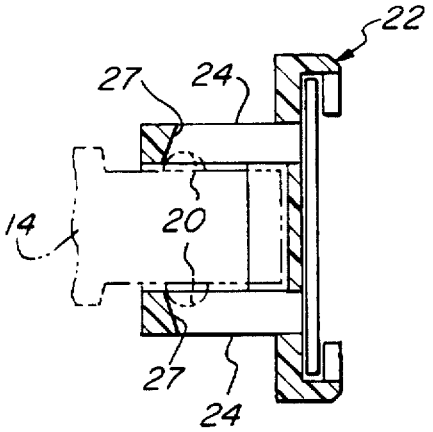
FIG. 6 is a cross-sectional view of the designation strip along line 6—6 in FIG. 5 showing the designation strip attached to a connector and showing the attachment flanges engaging attachment beads of the connector.
Figure 5:
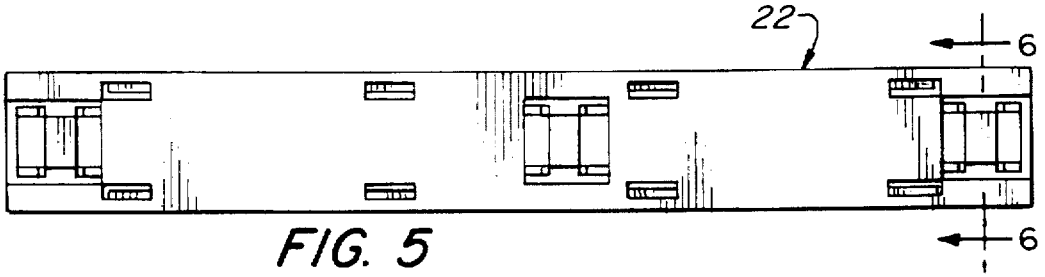
FIG. 5 is a rear elevation view of the back of the designation strip of FIG. 4.
Figure 4:
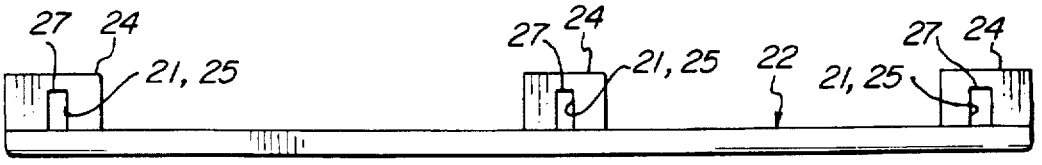
FIG. 4 is a top plan view of the designation strip of the present invention 8 showing the attachment flanges extending from the back surface.

Referring to FIG. 4, 5 and 6 the designation strips 22 include resilient attachment flanges 24 which include means 21 to engage the beads 20 on the insulation displacement connector 14. The designation strip 22 is releasably attachable to the connectors 14 by the resilient attachment flanges 24. The attachment flanges 24 engage the beads 20 and snap-fit thereover. Preferably the bead engaging means 21 comprises an engaging slot 25 and an engaging edge 27 which traps the bead 20 and secures the designation strip 22 to the connector 14.

Preferably, the attachment flanges 24 are aligned so as to be in sets of opposing attachment flanges 24 which engage the top and bottom beads 20 of one long tooth 18. Alternatively, top and bottom rows of attachment flanges could engage separate teeth.

Referring to FIG. 6 and 8, the engaging slot 25 and edge 27 serve to trap the bead 20 and attach the designation strip 22 to the connector 14.

Referring again to FIG. 1, the insulation displacement connector 14 described above has some features which are important to the present invention. First, the distance between the center points of adjacent beads 20 on the long teeth 18 of the connector 14 is a constant distance D1. Second, the distance D2 between any center point of a bead 20 on a long tooth 18 and an end wall 26 is equal to an odd integer multiple of one-half the distance D1 between adjacent beads 20 on long teeth 18. That is, the distance D2 between any bead 20 on a long tooth 18 and the end wall 26 is equal to $(2n-1)(1/2)*D1$, where n is a positive integer equal to the long tooth 18 number as counted from the end wall 26. Thus, bead 20' is (½)D1 from the end wall 26, bead 20" is (3½)D1 from the end wall 26, and bead 20'" is (5½)D1 from the end wall 26, etc. As will be further described below, the designation strip 22 of the present invention employs these distances to aid in attachment and alignment.

The means 21 to engage the beads 20 are spaced from one another at a distance D3 equal to integer multiples of distance D1 such that when one attachment flange 24 engages a bead 20, the other attachment flanges 14 will align with corresponding beads 20 on the connectors 14.

Figure 10:
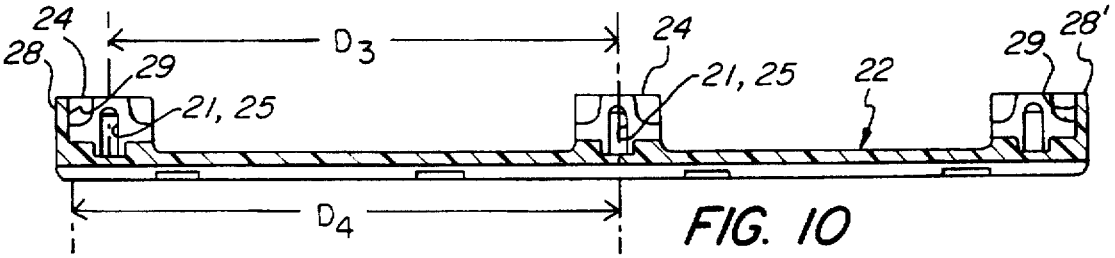
FIG.10 is bottom plan view of the designation strip of the present invention.

Referring to FIGS. 1 and 10, the designation strip 22 also includes a side wall 28 having an inside surface 29 which aids in attachment and alignment. The means 21 to engage the beads 20 are all spaced from the inside surface 29 of the side wall 28 at a distance D4 that is equal to an odd integer multiple of one-half the distance D1 between the beads 20 such that when the side wall 28 engages the end wall 26 of the connector 14, all of the means 21 to engage the beads 20 are automatically aligned with corresponding beads 20. This positively aligns the means 21 to engage the beads 20 of the designation strip 22 with the beads 20 during attachment. Thus, the designation strip can be quickly and positively attached and aligned by first engaging either side wall 28 of the designation strip 22 with either end wall 26 of the connector 14 and then urging all attachment flanges 14 over the beads 20 with which they are aligned. Other than aligning the side wall 28 with the end wall 26, no effort need be taken when attaching the designation strip 22 to ensure its alignment, and no additional adjustment is required.

Two side walls 28, 28' on either side of the designation strip 22 preclude the possibility that the designation strip 22 will be properly attached in any position other than precisely aligned. This is because the distances between the attachment flanges 24 and the side wall 28 are such that if a side wall 28 were not aligned with the end wall 26 of the connector 14, and were instead mistakenly inserted into a terminal slot 16, no attachment flange would align with a bead 20 on the connector. Thus, the side walls 28, 28' prevent the designation strip 22 from being properly attached if the designation strip 22 were misaligned with the connector 14 during attachment.

The side wall 28 of the designation strip 22 also prevents the designation strip 22 from becoming misaligned after attachment. Two side walls 28, 28' on either end of the designation strip effectively prevent the designation strip from becoming accidentally misaligned.

In addition to the positioning of the side wall 28 preventing misalignment of the designation strip 22, the dimensions of side wall 28 may also serve to prevent the designation strip 22 from being misaligned. That is, the length, width, and/or general configuration of the side wall 28 may prevent its improper insertion into a terminal slot 16. That is, if an attempt were made to attach the designation strip 22 in an incorrect position, one of the two side walls 28, 28' would become jammed in a terminal slot 16 preventing the proper attachment of the designation strip 22. For example, if the side wall 28 were thin enough to fit within one of the terminal slots 16, then it would need to be of such a length that it would contact other structure, such as the opposing conductors (not shown), to prevent the proper attachment of the designation strip 22. Alternatively, the configuration or width of the side wall 28 could be such that it is impossible to insert it into a terminal slot 16.

Figure 9:
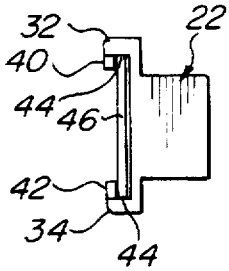
FIG. 9 is a side view of the designation strip of FIG. 1.

Referring to FIGS. 7 and 9, the designation strip 22 may include top and bottom rails 32, 34 which form a channel on the front surface 36 of the planar base 38. Top flanges 40 may extend downwardly from the top rail 32 and bottom flanges 42 may extend upwardly from the bottom rail 34 thereby forming groves 44 which may hold a designation label 46. Preferably, the top and bottom flanges 40, 42 cover a minimum amount of the surface of the designation label 46 in order to provide a maximum amount of visible space for information. Preferably, the designation label is comprised of a paper label which is covered in a plastic sheath, however any label or sticker is suitable.

Referring to FIG. 8, the sidewall 28 may be integrally formed with a set of opposing attachment flanges 24. The outside surface 30 of the sidewall 28 may also be aligned with an end 48 of the designation strip 22 providing a neat, efficient appearance.

The above description is for the purpose of teaching the person of ordinary skill in the art how to practice the invention, and it is not intended to detail all of those obvious modifications and variations of it which will become apparent to the skilled worker upon reading the description. It is intended, however, that all such obvious modifications and variations be included within the scope of the invention which is defined by the following claims. The claims are meant to cover the claimed elements and steps in any arrangement or sequence which is effective to meet the objectives there intended, unless the context specifically indicates the contrary.

What is claimed is:

1. A communication connection assembly comprising:

an insulation displacement connector having an end wall and having a plurality of teeth; said teeth having top and bottom surfaces;

attachment means connected to said top and bottom surfaces of said teeth;

a designation strip attached to said connector; said designation strip including:

a planar base having a back surface;

a plurality of attachment flanges connected to said back surface for attachment to said connector;

said attachment flanges having means to engage said attachment means of said connector;

at least one side wall connected to said back surface of said designation strip to align said engaging means of said strip with said attachment means of said connector, thereby aligning said strip with said connector during attachment, and to prevent said strip from becoming misaligned after attachment.

2. A claim as in claim 1 further comprising:

said attachment means being spaced apart at a constant first distance and being spaced from said end wall at distances equal to odd integer multiples of one-half of said first distance; and said side wall having an inside surface; said means to engage the attachment means being spaced apart at integer multiples of said constant first distance and being spaced from said inside surface of said side wall at distances equal to odd Integer multiples of one-half of said first distance.

3. A claim as in claim 2 wherein said attachment means further comprise beads and wherein said means to engage the attachment means comprise slots in said attachment flanges; said slots having an edge to trap said beads.

4. A claim as in claim 2 wherein said planar base further comprises a front surface and wherein said designation strip further comprises a designation label and a means to attach said designation label to said front surface.

5. A claim as in claim 4 wherein said designation strip further comprises top and bottom rails connected to said front surface; and wherein said means to attach said designation label further comprises at least one top flange downwardly depending from said top rail and at least one bottom flange upwardly depending from said bottom rail forming grooves to hold said designation label.

6. A claim as in claim 1 wherein said attachment means further comprise beads and wherein said means to engage the attachment means comprise slots in said attachment flanges; said slots having an edge to trap said beads.

7. A claim as in claim 1 wherein said planar base further comprises a front surface and wherein said designation strip further comprises a designation label and a means to attach said designation label to said front surface.

8. A claim as in claim 7 wherein said designation strip further comprises top and bottom rails connected to said front surface; and wherein said means to attach said designation label further comprises at least one top flange downwardly depending from said top rail and at least one bottom flange upwardly depending from said bottom rail forming grooves to hold said designation label.

9. A claim as in claim 1 further comprising said side wall being formed integrally and in one piece with two attachment flanges.

10. A claim as in claim 1 further comprising said side wall being substantially perpendicular to said attachment flanges and substantially perpendicular to said back surface.

11. A communication connection assembly comprising:

an insulation displacement connector having an end wall and having a plurality of teeth; said teeth having top and bottom surfaces;

attachment beads connected to said top and bottom surfaces of said teeth;

a designation strip attached to said connector; said designation strip including:

a planar base having front and back surfaces;

a designation label and a means to attach said designation label to said front surface;

a plurality of attachment flanges connected to said back surface for attachment to said connector;

said attachment flanges having slots to engage said attachment beads of said connector;

at least one side wall connected to said back surface of said designation strip to align said slots of said strip with said attachment beads of said connector, thereby aligning said strip with said connector during attachment, and to prevent said strip from becoming misaligned after attachment;

said attachment beads being spaced apart at a constant first distance and being spaced from said end wall at distances equal to odd integer multiples of one-half of said first distance; and said side wall having an inside surface; said slots being spaced apart at integer multiples of said constant first distance and being spaced from said inside surface of said side wall at distances equal to odd integer multiples of one-half of said first distance.

12. A claim as in claim 11 further comprising said side wall being formed integrally and in one piece with two attachment flanges; and said side wall being substantially perpendicular to said attachment flanges and substantially perpendicular to said back surface.

13. A claim as in claim 11 wherein said designation strip further comprises top and bottom rails connected to said front surface; and wherein said means to attach said designation label further comprises at least one top flange downwardly depending from said top rail and at least one bottom flange upwardly depending from said bottom rail forming grooves to hold said designation label.

14. A claim as in claim 11 further comprising two side walls connected to said back surface of said designation strip; said side walls having inside surfaces; and said slots being spaced from both of said inside surfaces of said side walls at distances equal to odd integer multiples of one-half said first distance.

* * * * *